US009037072B2

(12) United States Patent
Matsumoto

(10) Patent No.: US 9,037,072 B2
(45) Date of Patent: May 19, 2015

(54) MEDIUM LOADER DEVICE AND IMAGE FORMATION APPARATUS

(71) Applicant: Oki Data Corporation, Tokyo (JP)

(72) Inventor: Keigo Matsumoto, Tokyo (JP)

(73) Assignee: Oki Data Corporation, Tokyo (JP)

( * ) Notice: Subject to any disclaimer, the term of this patent is extended or adjusted under 35 U.S.C. 154(b) by 176 days.

(21) Appl. No.: 13/719,306

(22) Filed: Dec. 19, 2012

(65) Prior Publication Data

US 2013/0164064 A1 Jun. 27, 2013

(30) Foreign Application Priority Data

Dec. 27, 2011 (JP) ..... 2011-286314

(51) Int. Cl.
*B65H 1/04* (2006.01)
*B65H 1/00* (2006.01)

(52) U.S. Cl.
CPC ..... *B65H 1/00* (2013.01); *B65H 2407/21* (2013.01); *B65H 1/04* (2013.01); *B65H 2402/441* (2013.01); *B65H 2405/11164* (2013.01); *B65H 2405/324* (2013.01); *B65H 2601/523* (2013.01)

(58) Field of Classification Search
CPC ..... B41J 29/023; B65H 2402/31; B65H 2407/21; B65H 2405/11164; G03G 15/6514; G03G 2215/00392
USPC ..... 399/392; 271/9.09
See application file for complete search history.

(56) References Cited

U.S. PATENT DOCUMENTS 7,484,722 B2 * 2/2009 Ishii ..... 271/9.09
7,748,691 B2 * 7/2010 Mizuguchi ..... 271/9.09

FOREIGN PATENT DOCUMENTS

JP 2004256181 * 9/2004 ..... B65H 1/04
JP 2009-263078 A 11/2009
JP 2010-241606 A 10/2010

* cited by examiner

*Primary Examiner* — Blake A Tankersley
(74) *Attorney, Agent, or Firm* — Marvin A. Motsenbocker; Mots Law, PLLC

(57) ABSTRACT

A medium loader device includes a first medium loader member configured to load a medium, a second medium loader member usable as an extension of the first medium loader member, and a support member configured to support the first medium loader member and the second medium loader member and to form a storage area capable of storing the second medium loader member between the support member and the first medium loader member. The support member includes a holder configured to hold the first medium loader member such that the first medium loader member moves relative to the support member when the second medium loader member is moved from a usage position where the second medium loader member is used as the extension of the first medium loader member to a storage position where the second medium loader member is stored in the storage area.

9 Claims, 20 Drawing Sheets

MEDIUM LOADER DEVICE AND IMAGE FORMATION APPARATUS

CROSS REFERENCE TO RELATED APPLICATIONS

This application claims priority based on 35 USC 119 from prior Japanese Patent Application No. 2011-286314 filed on Dec. 27, 2011, entitled "MEDIUM LOADER DEVICE AND IMAGE FORMATION APPARATUS", the entire contents of which are incorporated herein by reference.

BACKGROUND OF THE INVENTION

1. Field of the Invention

This disclosure relates to a medium loader device and an image formation apparatus, which may be applicable to a printer including a manual tray, for example.

2. Description of Related art

A conventional image formation apparatus such as a printer includes a paper cassette (medium cassette) capable of containing paper therein and a manual tray as a medium loader device capable of containing therein, and feeding, paper (medium) loaded from the outside.

Such a conventional printer including a manual tray is described in Patent Document 1 (Japanese Patent Application Publication No. 2010-241606).

In order to reduce storage space, the manual tray described in Patent Document 1 has a structure in which an auxiliary tray for extending a medium load surface of a medium feed tray is rotatably supported with the medium feed tray and is folded onto the medium feed tray when the manual tray is stored.

SUMMARY OF THE INVENTION

However, in order to downsize the printer, it is preferable to reduce the space (volume) required to store the manual tray (medium loader device).

For this reason, a medium loader device and an image formation apparatus capable of reducing the storage space are desired.

A first aspect of the invention is a medium loader device including: a first medium loader member configured to load a medium; a second medium loader member usable as an extension of the first medium loader member; and a support member configured to support the first medium loader member and the second medium loader member and to form a storage area capable of storing the second medium loader member between the support member and the first medium loader member. The support member includes a holder configured to hold the first medium loader member such that the first medium loader member moves relative to the support member when the second medium loader member is moved from a usage position where the second medium loader member is used as the extension of the first medium loader member, to a storage position where the second medium loader member is stored in the storage area.

A second aspect of the invention is a medium loader device including: a first medium loader member configured to load a medium;

a second medium loader member movable relative to the first medium loader member; and a support member configured to support the first medium loader member and the second medium loader member and to form a storage area capable of storing the second medium loader member between the support member and the first medium loader member. The first medium loader member is moved so as not to hinder movement of the second medium loader member in conjunction with the operation of moving the second medium loader member to the storage area.

According to these aspects, the space required to store the medium loader device can be reduced.

DETAILED DESCRIPTION OF EMBODIMENTS

Figure 1B:
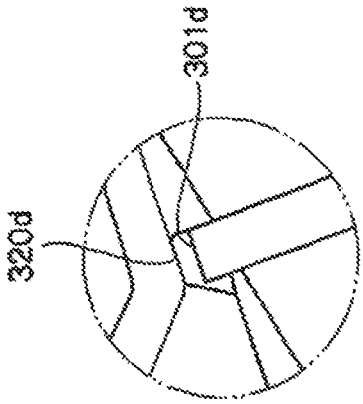
FIG. 1B is a partially enlarged cross-sectional view of the manual tray.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

(A) First Embodiment

A first embodiment of a medium loader device and an image formation apparatus according to the invention is described in detail below with reference to the drawings. Note that the medium loader device of the first embodiment is a manual tray.

(A-1) Configuration and Operations of the First Embodiment

Figure 2:
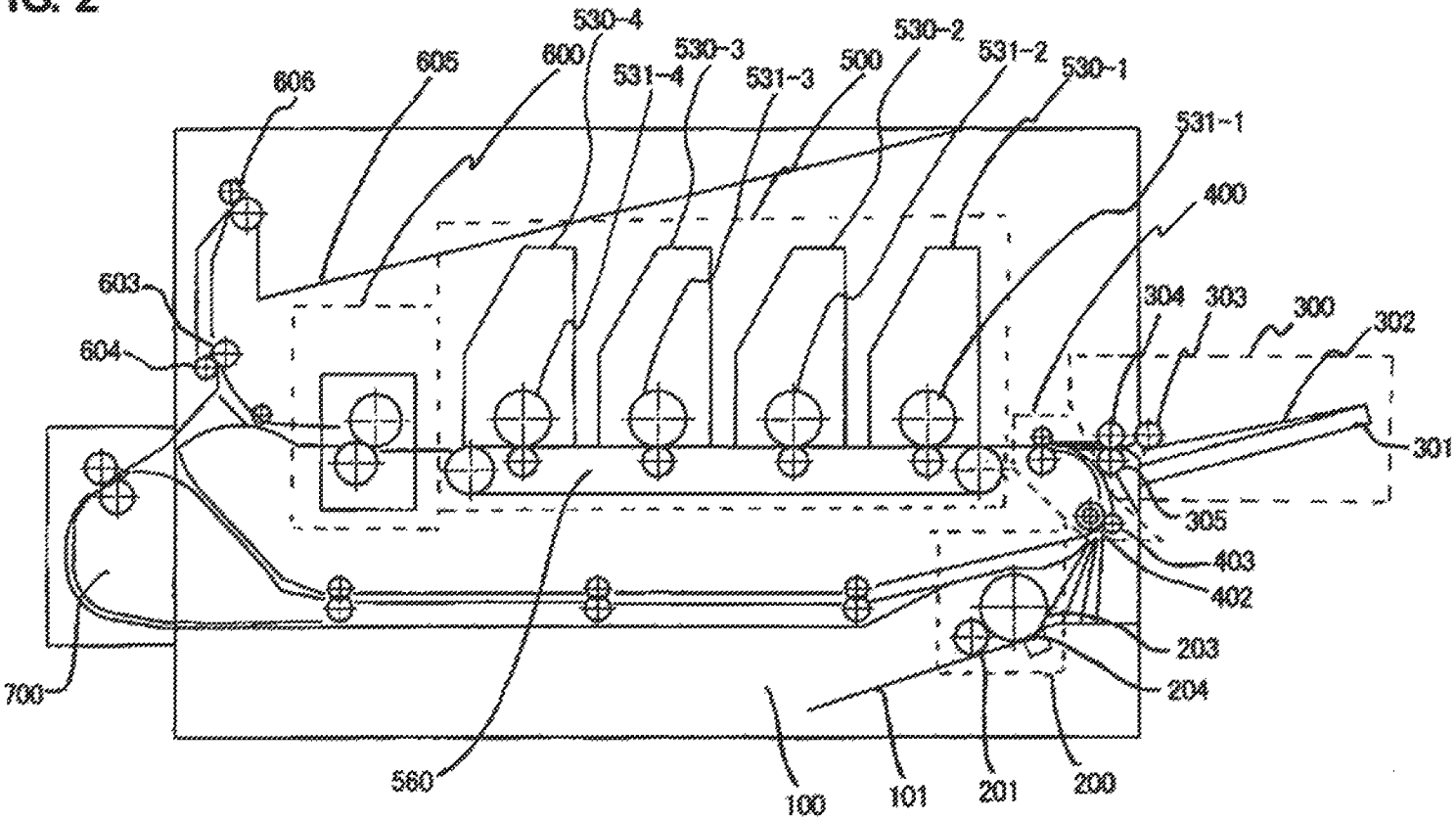
FIG. 2 is a schematic cross-sectional view of image formation apparatus 1 including the manual tray according to the first embodiment.

FIG. 2 is a schematic cross-sectional view of image formation apparatus 1 including the manual tray according to the first embodiment.

Image formation apparatus 1 (printer) shown in FIG. 2 includes paper tray 100, paper feed unit 200, manual tray 300, paper conveyance unit 400, image formation unit 500, and fixing unit 600.

Inside image formation apparatus 1, paper as a medium is stacked on paper tray 100, and paper feed unit 200 configured to feed the paper one by one is provided on the paper feed side.

Paper feed unit 200 is provided with feed roller 203 and separator 204 configured to separate the paper piece by piece, which is fed by pickup roller 201. Pickup roller 201 is provided to come into pressure contact with paper 101 stacked at the top when the paper is lifted to a predetermined height.

Manual tray 300 as the medium loader device includes paper loader plate 302 configured to load the paper, pickup roller 303 as a medium feeder provided to come into pressure contact with paper loader plate 302, feed roller 304 configured to separate the paper piece by piece, which is fed by pickup roller 303, and retard roller 305.

Paper conveyance unit 400 conveys the paper to image formation unit 500, the paper being separated piece by piece and fed by paper feed unit 200 and manual tray 300. Paper conveyance unit 400 includes a pair of conveyance rollers 902 and 403 to convey the fed paper.

Image formation unit 500 includes four serially-arranged toner image formation units 530 (530-1 to 530-9) and transfer unit 560 configured to transfer toner images formed by toner image formation units 530 (530-1 to 530-9) onto a paper top surface by a coulomb force. Toner image formation units 530-1 to 530-4 are configured to develop the toner images (form images) on the paper using cyan, magenta, yellow and black toners (developers), respectively. Moreover, toner image formation units 530 (530-1 to 530-9) have photosensitive drums 531 (531-1 to 531-40.

In each of toner image formation units 530, photosensitive drum 531 is charged by a charge roller (not shown). Image data is written onto photosensitive drum 531 which is rotated by an optical head (not shown), and the image data is developed with the toner, thereby obtaining the toner image on photosensitive drum 531.

Fixing unit 600 is configured to fix the toner image to the paper with heat and pressure, the toner image being transferred onto the paper by transfer unit 560. Fixing unit 600 includes a pair of discharge rollers 603 and 604 configured to discharge (let out) the paper having the toner image fixed thereto from outlet 606. Fixing unit 600 also has a loading unit 605 configured to load the paper discharged from outlet 606.

Next, manual tray 300 is described in detail.

Figure 3:
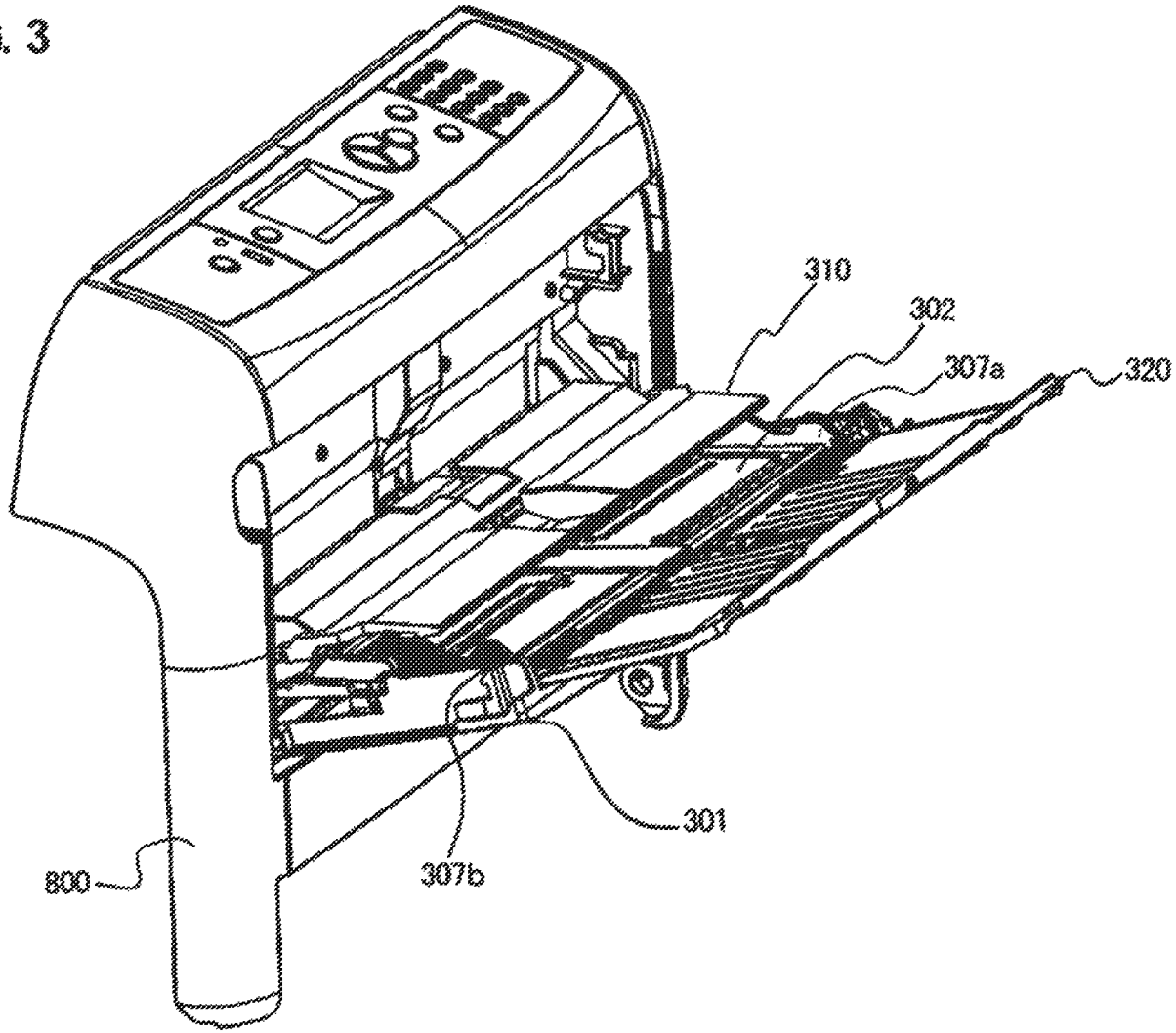
FIG. 3 is a perspective view of the manual tray according to the first embodiment, showing a paper holder plate pulled out.

FIG. 3 is a perspective view of manual tray 300 attached to image formation apparatus 1.

Figure 1A:
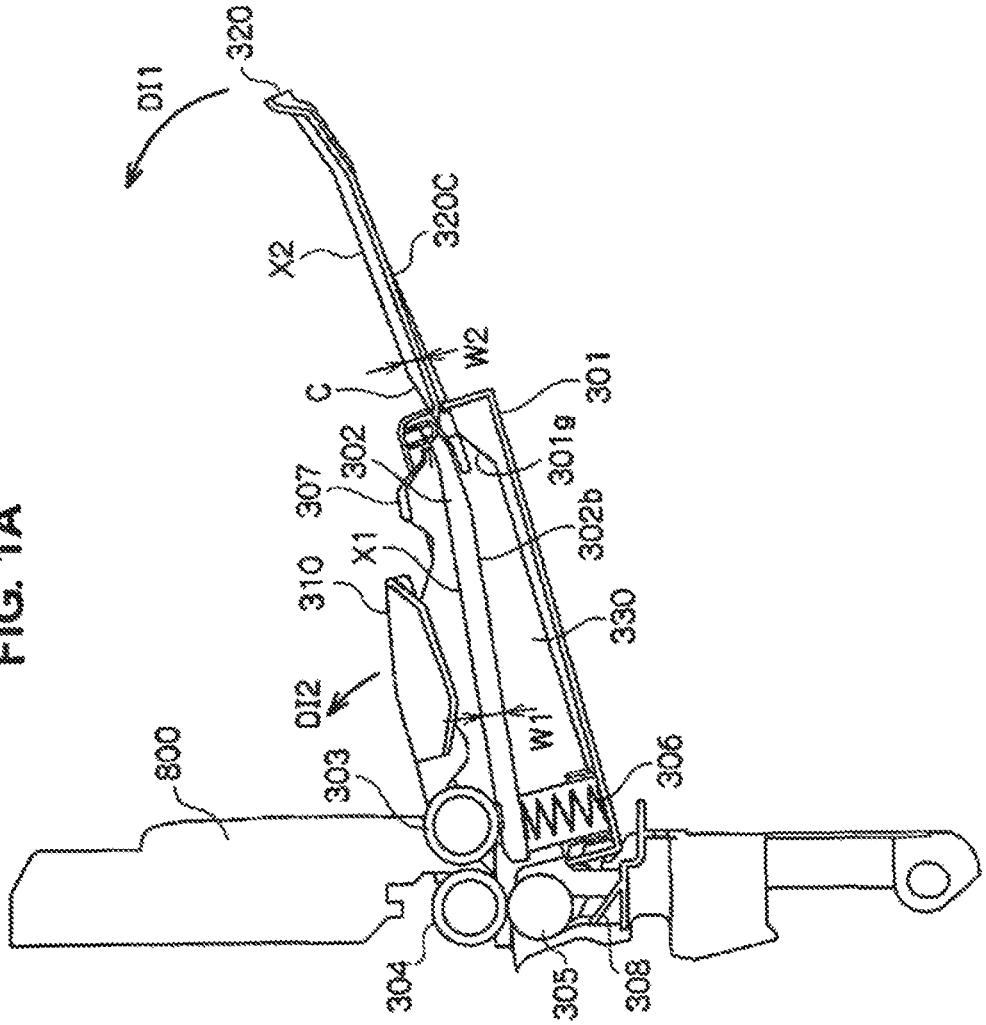
FIG. 1A is a cross-sectional view of a manual tray according to a first embodiment, showing that the manual tray is attached to an image formation apparatus.

FIG. 1 is a cross-sectional view of manual tray 300 attached to apparatus main body 800 (main body of image formation apparatus 1). Note that FIG. 1A is a cross-sectional view including the entire manual tray 300, while FIG. 1B is a partially enlarged cross-sectional view of manual tray 300.

Figure 4:
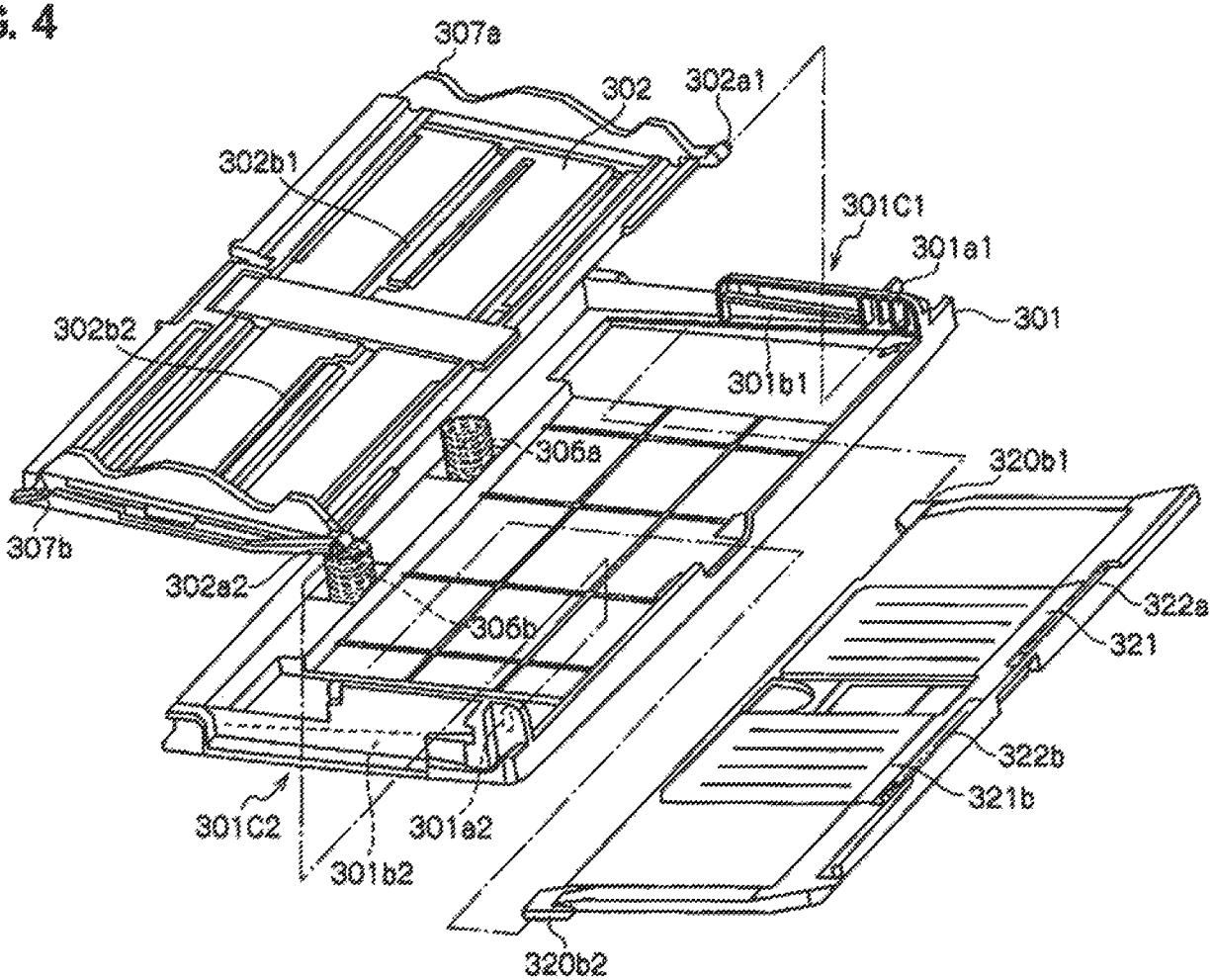
FIG. 4 is a perspective view of the manual tray according to the first embodiment, showing the manual tray broken down into a frame, a paper loader plate and the paper holding plate.

FIG. 4 is a perspective view of manual tray 300 broken down into frame 301, paper loader plate 302 and paper holder plate 320.

As shown in FIG. 3, manual tray 300 has frame 301 as a support member. Frame 301 is fixed to image formation apparatus 1 (shown as "apparatus main body 800" in FIG. 1) so as to be rotatable in an arrow direction (arrow a or arrow b direction) shown in FIG. 5.

Note that, in the following description of the configuration of manual tray 300, a direction (a horizontal direction in FIG. 1) parallel to the direction of feeding the paper into image formation apparatus 1 (hereinafter referred to as the "paper feed direction") on a load surface to load the paper is called a "length direction". Meanwhile, a direction perpendicular to the paper feed direction (a direction perpendicular to the length direction described above) on the load surface to load the paper is called a "width direction". Moreover, in the following description of the configuration of manual tray 300, an upstream side of the paper feed (right-hand side in FIG. 1) is called a "paper feed upstream side", while a downstream side of the paper feed (left-hand side in FIG. 1) is called a "paper feed downstream side".

Paper loader plate 302 as a first medium loading unit included in manual tray 300 is supported by frame 301.

Note that a surface of paper loader plate 302, on which the paper is to be loaded (a top surface in the state shown in FIG. 1) is hereinafter called paper load surface X1 as a first paper load surface of manual tray 300. Moreover, a surface of paper loader plate 302 opposite to paper load surface X1 (a bottom surface in the state shown in FIG. 1) is hereinafter called bottom surface 302*b*.

On paper load surface X1 of paper loader plate 302, a pair of paper guides 307*a* and 307*b* are provided. When the paper is fed into the main body of image formation apparatus 1, paper guides 307*a* and 307*b* control the paper loaded on paper load surface X1 so that the sides of the paper in the length direction are aligned in parallel to the feed direction, and the paper being fed is located in a predetermined position in the width direction. Moreover, paper guides 307*a* and 307*b* are provided movably (slidably) in the width direction along a pair of grooves 302*b* 1 and 302*b*2 provided in paper load surface X1 of paper loader plate 302 (see FIG. 40.

Moreover, manual tray 300 is also provided with paper holder plate 320 as a second medium loader member on the upstream side of paper loader plate 302 in the paper feed direction. Specifically, paper holder plate 320 is used in a case, for example, where the paper to be loaded on paper load surface X1 is long in the length direction (e.g., paper of A3 size or the like) and cannot be held only with paper load surface X1 (where the paper sticks out of paper load surface X1 in the length direction). Paper holder plate 320 is supported by frame 301. Note that the surface of paper holder plate 320, on which the paper is to be loaded (a top surface in the state shown in FIG. 1) is hereinafter called paper load surface X2 as a second paper load surface of manual tray 300. Furthermore, the surface of paper holder plate 320 opposite to paper load surface X2 (a bottom surface in the state shown in FIG. 1) is hereinafter called bottom surface 320*c*.

Pickup roller 303 is provided to be in pressure contact with paper load surface X1 of paper loader plate 302 (the paper loaded on paper load surface X1). Feed roller 304 is rotatably attached to the apparatus main body and is rotated by a motor (not shown) or the like. Pickup roller 304 and feed roller 303 are coupled by an idle gear (not shown).

Moreover, a torque limiter (not shown) is coupled to retard roller 305, and spring 308 is disposed below retard roller 305. Retard roller 305 is biased (lifted) upward (toward feed roller 304) by spring 308. In other words, retard roller 305 is pressed against feed roller 304 by spring 308.

Between paper loader plate 302 and frame 301, two springs 306 (306*a* and 306*b* ) as elastic members are provided at end positions on the paper feed downstream side (positions below pickup roller 303). Paper loader plate 302 is biased (lifted) upward, i.e., toward pickup roller 303 from frame 301 by springs 306. In other words, the end of paper loader plate 302 on the paper feed downstream side is placed on springs 306 (306*a* and 306*b* ). Although the number of springs 306 is two in this embodiment, the number of springs 306 to be provided is not limited thereto.

As shown in FIGS. 1 and 4, a pair of posts 302*a*1 and 302*a*2 as rotation fulcrums are provided at both ends of paper loader plate 302 on the paper feed upstream side (both ends in the width direction).

Meanwhile, in frame 301, a pair of holders 301C1 and 301C2 are provided upright, which support (hold) paper loader plate 302 and paper holder plate 320 from the outside. In inner surfaces of holders 301C1 and 301C2, a pair of elongate holes 301*a*1 and 301*a*2 are provided as first loader member support parts, into which the pair of posts 302*a*1 and 302*a*2 of paper loader plate 302 are fitted. More specifically, the end of paper loader plate 302 on the paper feed upstream side is supported movably (slidably) within the width of elongate holes 301*a*1 and 301*a*2 in a direction approximately perpendicular to paper load surface X1, i.e., a direction in which paper load surface X1 controls the paper. Note that elongate holes 301*a*1 and 301*a*2 each have an approximately elongate shape extending in the direction in which paper load surface X1 controls the paper.

Moreover, on the inner surfaces of holders 301C1 and 301C2, guide members 301*b*1 and 301*b*2 are provided in the length direction as second loader member support parts. Moreover, at both ends of paper loader plate 302 in the width direction, a pair of engagement protrusions 320*b*1 and 320*b*2 are provided, which can be engaged with guide members 301*b*1 and 301*b*2 of frame 301. More specifically, paper holder plate 320 is supported movably (slidably) in the length direction, i.e., toward the upstream side or downstream side in the paper feed direction along guide members 301*b*1 and 301*b*2. Paper holder plate 320, when moved toward the paper feed upstream side, functions as a part of paper loader plate 302 extended (expanded) in the length direction. In other words, paper holder plate 320 can serve as an extension of paper loader plate 302. When paper holder plate 320 is moved toward the paper feed upstream side, a part of the paper running off paper loader plate 302 in the length direction is placed on the top surface of paper holder plate 320, even if a long paper is loaded on paper loader plate 302, for example, and thus the paper can be stably loaded.

Figure 5:
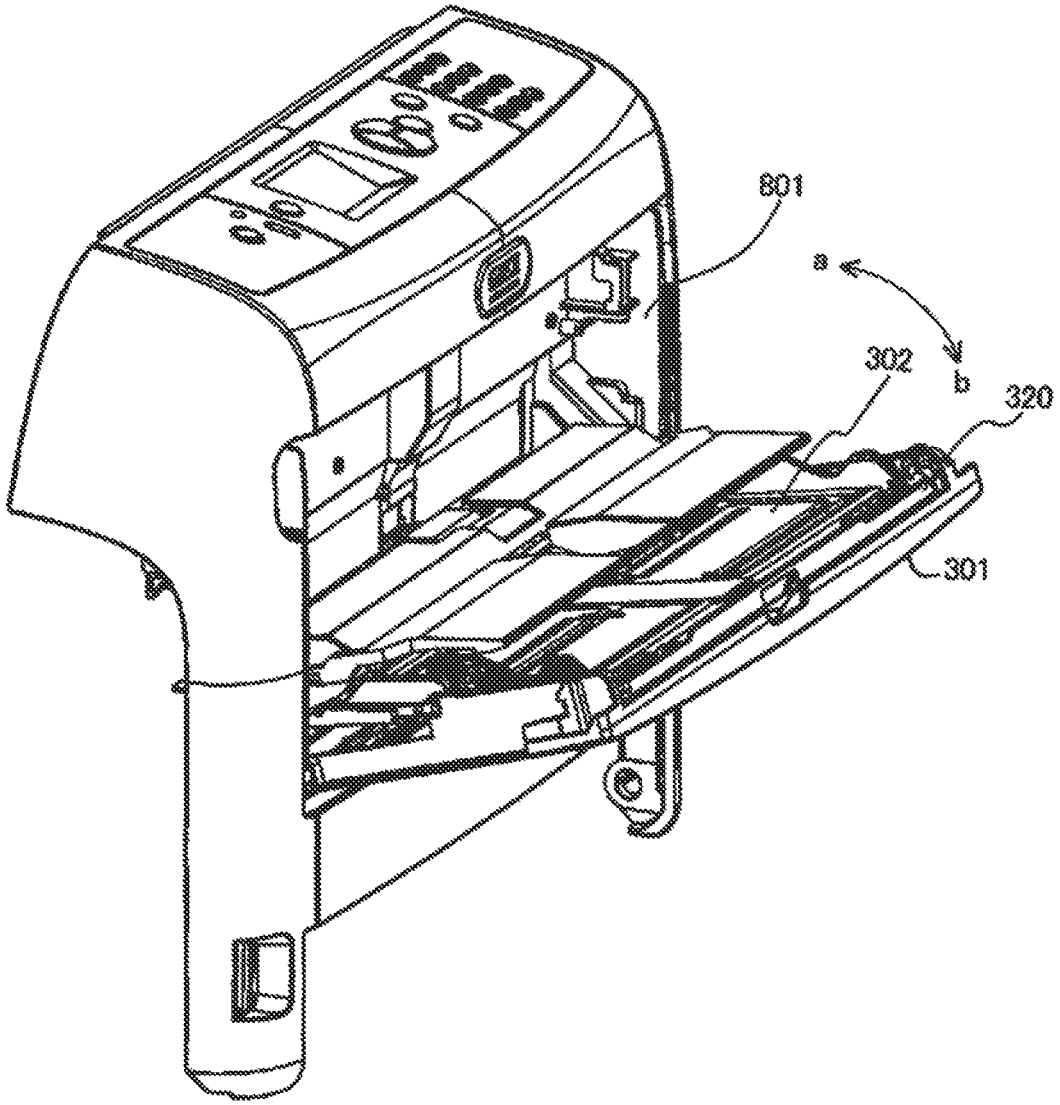
FIG. 5 is a perspective view of the manual tray according to the first embodiment, showing the paper holder plate as stored.

In manual tray 300, paper holder plate 320 when not in use can be stored inside frame 301 (in the space between frame 301 and paper loader plate 302) as shown in FIG. 5. An area (space) capable of storing paper holder plate 320 in manual tray 300 is hereinafter called storage area 330.

Note that a direction of drawing paper holder plate 320 out of storage area 330 is hereinafter called a "drawing direction", while a direction of pushing and storing paper holder plate 320 into storage area 330 is hereinafter called a "storage direction".

As shown in FIG. 1, an end of frame 301 on the paper feed upstream side is provided with engagement protrusion part 301*d* to be engaged with engagement recess part 320*d* in paper holder plate 320. On the other hand, bottom surface 320*c* of paper holder plate 320 is provided with groove-shaped engagement recess part 320*d* to be engaged with frame 301 (engagement protrusion part 301*d*). When paper loader plate 302 reaches a predetermined position while being moved in the drawing direction, engagement recess part 320*d* of paper loader plate 302 is engaged with engagement protrusion part 301*d* of frame 301, and thus the movement (movement in the drawing direction and storage direction) is blocked. In other words, in manual tray 300, paper loader plate 302 is configured to be movable in the drawing direction up to the point where engagement recess part 320*d* of paper loader plate 302 and engagement protrusion part 301*d* of frame 301 are engaged with each other.

Next, an operation of storing paper holder plate 320 in storage area 330 in manual tray 300 is described. In the following description, a position where paper loader plate 302 moved in the drawing direction is locked as shown in FIG. 1 (a position where paper holder plate 320 is used) is called a "first position", while a position where paper holder plate 320 is stored in storage area 330 as shown in FIG. 5 is called a "second position".

Figure 6B:
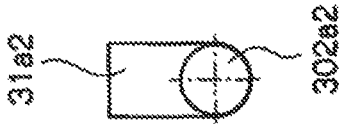
FIG. 6B is a partially enlarged cross-sectional view of FIG. 6A.
Figure 6A:
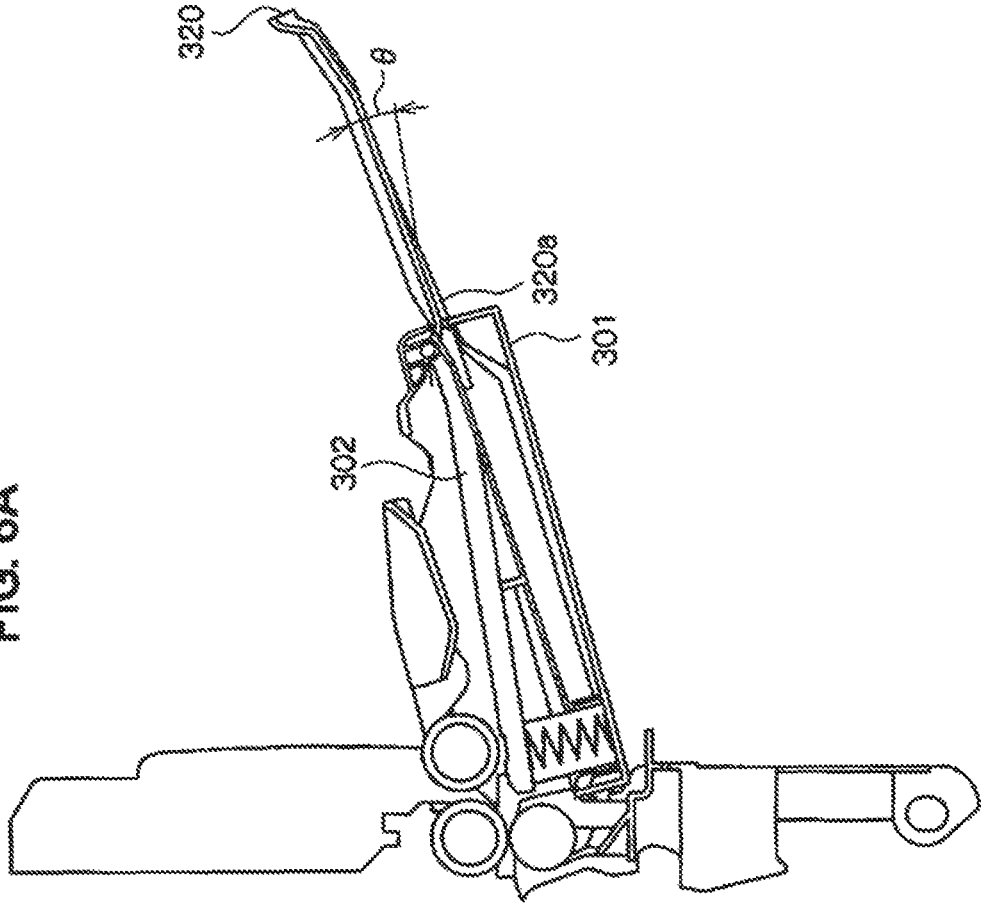
FIG. 6A is a cross-sectional view of the manual tray according to the first embodiment, showing that the paper holder plate is disposed at a first position (usage position).

FIG. 6 is a cross-sectional view showing that paper holder plate 320 is located at the first position in manual tray 300. Note that FIG. 6A is a cross-sectional view including the entire manual tray 300, while FIG. 63 is a partially enlarged cross-sectional view of manual tray 300, showing one of its parts (a portion around elongate holes 301*a*1 and 301*a*2) in closeup.

Figure 7B:
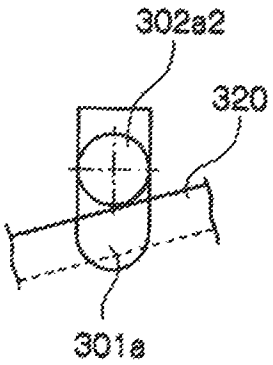
FIG. 7B is a partially enlarged cross-sectional view of FIG. 7A.
Figure 7A:
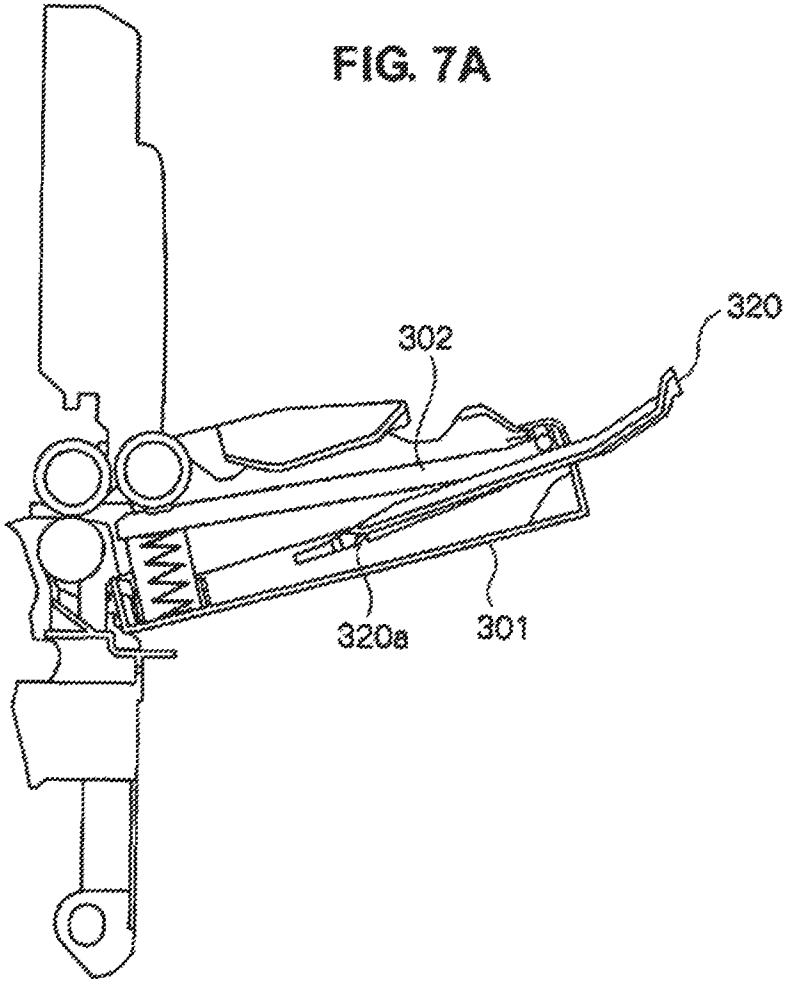
FIG. 7A is a cross-sectional view of the manual tray according to the first embodiment, showing the paper holder plate in the process of being moved from the first position (usage position) to a second position (storage position).

FIG. 7 is a cross-sectional view showing that paper holder plate 320 is in the process of being moved from the first position to the second position in manual tray 300. Note that FIG. 7A is a cross-sectional view including the entire manual tray 300, while FIG. 7B is a partially enlarged cross-sectional view of manual tray 300, showing one of its parts (the portion around elongate holes 301*a*1 and 301*a*2) in closeup.

Figure 8B:
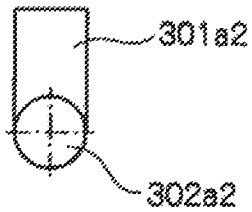
FIG. 8B is a partially enlarged cross-sectional view of FIG. 8A.
Figure 8A:
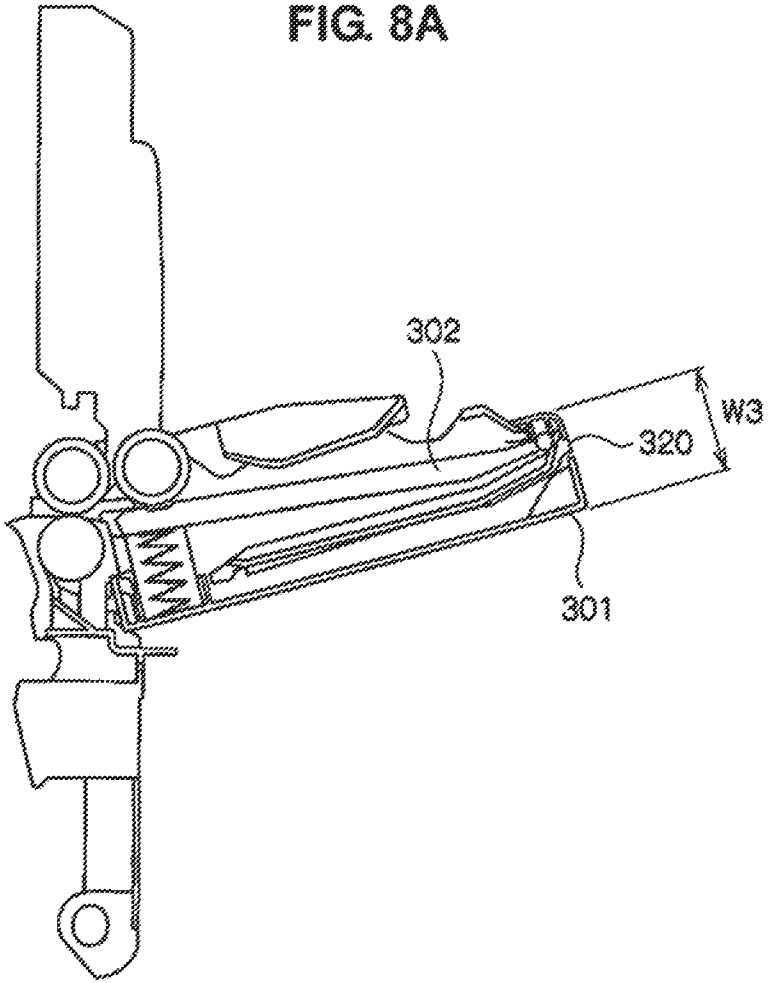
FIG. 8A is a cross-sectional view of the manual tray according to the first embodiment, showing the paper holder plate disposed at the second position (storage position).

FIG. 8 is a cross-sectional view showing that paper holder plate 320 is located at the second position in manual tray 300. Note that FIG. 8A is a cross-sectional view including the entire manual tray 300, while FIG. 83 is a partially enlarged cross-sectional view of manual tray 300, showing one of its parts (the portion around elongate holes 301*a*1 and 301*a*2) in closeup.

When paper holder plate 320 is located at the first position (see FIG. 6), engagement recess part 320*d* of paper loader plate 302 and engagement protrusion part 301*d* of frame 301 are engaged with each other, and thereby lock paper loader plate 302 so as to keep paper loader plate 302 from moving in the drawing direction and storage direction. Although paper loader plate 302 moves downward by its own weight, the downward (downward in FIG. 6) movement is blocked since posts 302*a*1 and 302*a*2 come into contact with the lowest points (lower ends) of elongate holes 301*a*1 and 301*a*2 in frame 301.

When paper loader plate 302 is lifted upward (upward in FIG. 6) from the state where paper holder plate 320 is in the first position, the engagement between engagement recess part 320*d* of paper loader plate 302 and engagement protrusion part 301*d* of frame 301 is released, thereby enabling paper loader plate 302 to move in the length direction (the drawing direction and storage direction). Here, the engagement between engagement recess part 320*d* of paper loader plate 302 and engagement protrusion part 301*d* of frame 301 is released, and paper loader plate 302 is pushed in the storage direction and then stored in storage area 330.

With reference to FIG. 7, a description is given of the process of pushing paper loader plate 302 in the storage direction and storing paper loader plate 302 in storage area 330 (the process of moving paper holder plate 320 from the first position to the second position).

In this case, paper loader plate 302 is moved in the storage direction along guide members 301*b*1 and 301*b*2 of frame 301. In this event, paper holder plate 320 goes under paper loader plate 302, and paper loader plate 302 is pushed upward (downward in FIG. 70. Here, posts 302*a*1 and 302*a*2 of paper loader plate 302 can be moved upward up to the upper ends of elongate holes 301*a*1 and 301*a*2. Thus, posts 302*a*1 and 302*a*2 are moved upward, thereby increasing a space between paper loader plate 302 and frame 301. Thus, paper holder plate 320 can pass through the space to the storage area 330.

Then, when paper holder plate 320 is moved in the storage direction until paper holder plate 320 is stored in storage area 330 (up to the second position), the state shown in FIG. 8 is established. In this state, paper loader plate 302 moves downward by its own weight. However, the downward (downward in FIG. 8) movement is blocked by the contact of posts 302*a*1 and 302*a*2 and the lowest points (lower ends) of elongate holes 301*a*1 and 301*a*2 in frame 301.

Since moving paper holder plate 320 from the second position to the first position undergoes a reverse process from that described above, a detailed description thereof is omitted here.

As described above, paper holder plate 320 is movably supported in manual tray 300.

At the end of paper holder plate 320 in the paper feed upstream direction, extension leaf 321 is attached to further extend (expand) paper holder plate 320 in the length direction. Extension leaf 321 is formed so that its dimension in the width direction is smaller than that of paper holder plate 320.

Figure 9:
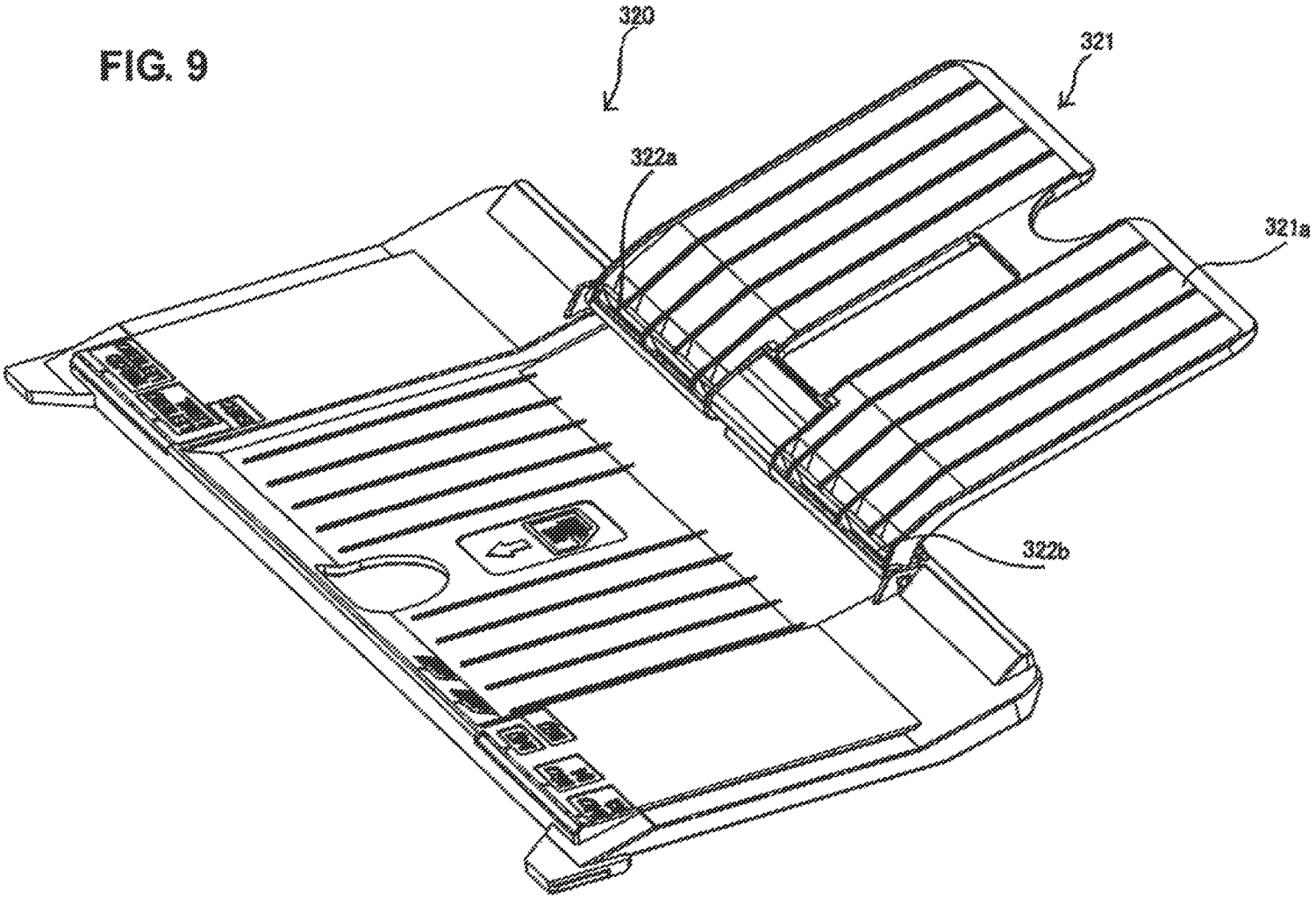
FIG. 9 is a perspective view of the paper holder plate according to the first embodiment, showing an extension leaf as unfolded.

Moreover, as shown in FIG. 9, two shafts 322*a* and 322*b* are provided at the end of paper holder plate 320 in the paper feed upstream direction. Two shafts 322*a* and 322*b* are disposed on the same rotation axis. More specifically, two shafts 322*a* and 322*b* form one rotation shaft. At one end of extension leaf 321 in the length direction, a through-hole is provided, into which shafts 322*a* and 322*b* are inserted. Extension leaf 321 is attached to paper holder plate 320 rotatably about shafts 322*a* and 322*b* as the rotation axis.

When paper holder plate 320 does not use extension leaf 321, extension leaf 321 can be folded to, and stored on, paper holder plate 320 as shown in FIG. 4. On the other hand, when paper holder plate 320 uses extension leaf 321, extension leaf 321 needs to be rotated (unfolded) in a direction away from paper holder plate 320 as shown in FIG. 9. As shown in FIG. 9, extension leaf 321 in the unfolded state serves as apart further extending (expanding) paper holder plate 320 in the length direction. A surface facing upward (upward in FIG. 9) in the unfolded state of extension leaf 321 (a surface on which the paper is loaded) is hereinafter called "paper load surface 321*a*". Moreover, a surface opposite to paper load surface 321*a* is hereinafter called "bottom surface 321*b*".

When extension leaf 321 is rotated in the direction away from paper holder plate 320 about shafts 322*a* and 322*b* as the rotation axis from the folded state on paper holder plate 320 side (the state shown in FIG. 4), the rotation is limited up to a predetermined direction in which paper load surface 321*a* of the main body of extension leaf 321 is approximately parallel to paper holder plate 320. In other words, extension leaf 321 is configured so that when paper load surface 321*a* of extension leaf 321 becomes approximately parallel to the top surface of the main body of paper holder plate 320 along with the rotation about shafts 322*a* and 322*b* as the rotation axis to the predetermined direction, further rotation is blocked since surface 321*b* comes into contact with the main body of paper holder plate 320.

Figure 10:
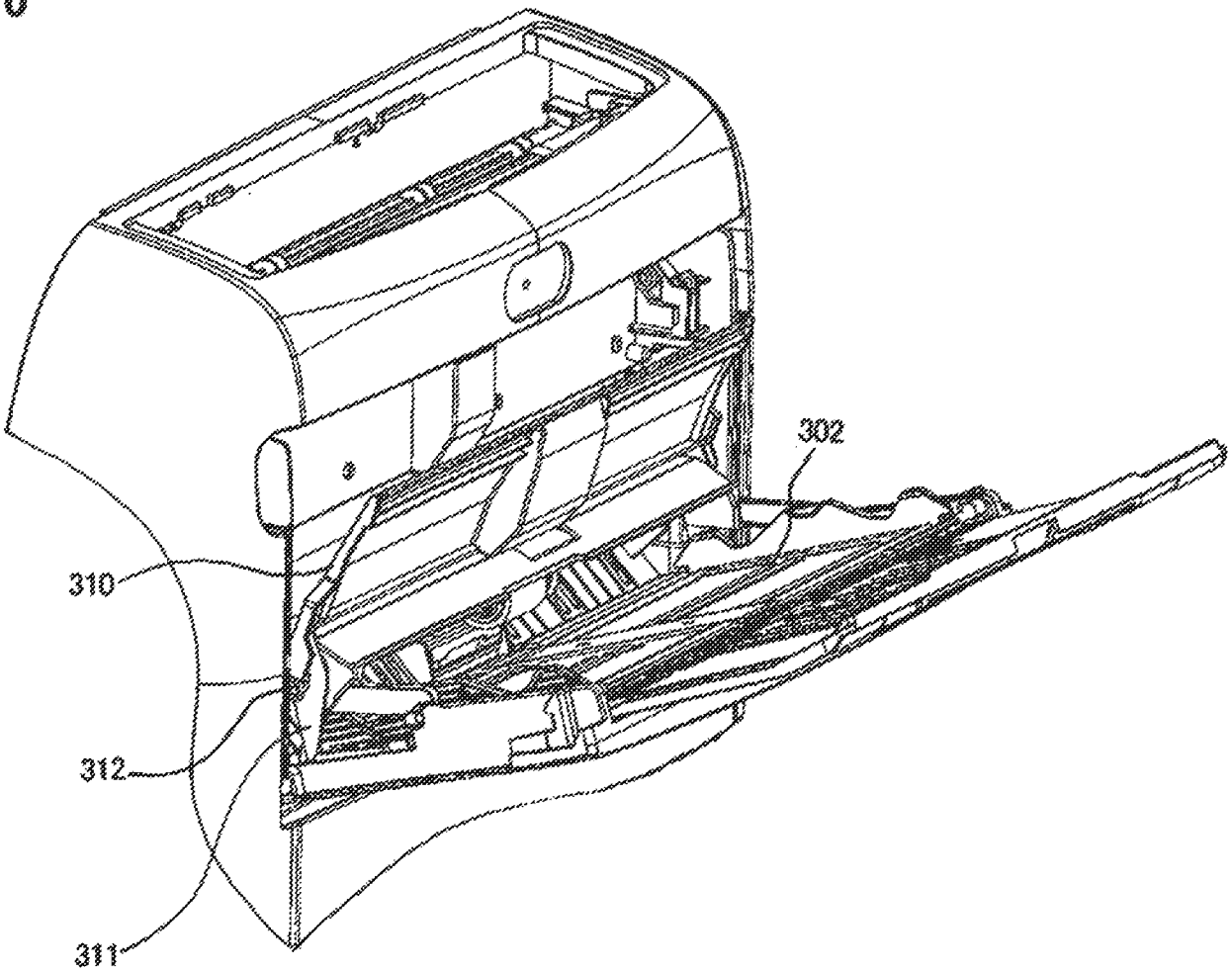
FIG. 10 is a perspective view of the manual tray according to the first embodiment, showing the paper loader plate pressed down by a lever.

As shown in FIGS. 3 and 10, lever 310 is attached to apparatus main body 800 rotatably about shaft 312 as a rotation axis. Lever 310 is provided with pressure part 311. When lever 310 is rotated (rotated in DI2 direction in the cross-sectional view shown in FIG. 1) from the state shown in FIG. 3, pressure part 311 can push down paper load surface X2 of paper loader plate 302 (push downward in the cross-sectional view shown in FIG. 1). FIG. 10 is a perspective view showing the state where pressure part 311 presses down paper load surface X2 of paper loader plate 302. In manual tray 300, when lever 310 pushes down paper load surface X2 of paper loader plate 302, pressure contact of pickup roller 201 with the loaded paper is released. Thus, the loaded paper can be easily removed.

Note that, in FIG. 10, pressure part 311 is formed into an approximately triangular plate with the side of shaft 312 as its base. When lever 310 is rotated in the DI2 direction, a tip portion of one corner of the triangle pushes paper load surface X2 by coming into contact therewith. Note that the shape of pressure part 311 and the number of pressure parts 311 to be provided are not limited as long as pressure part 311 can push down paper load surface X2 along with the rotation of lever 310. The shape thereof may be oval, square or the like.

Figure 19:
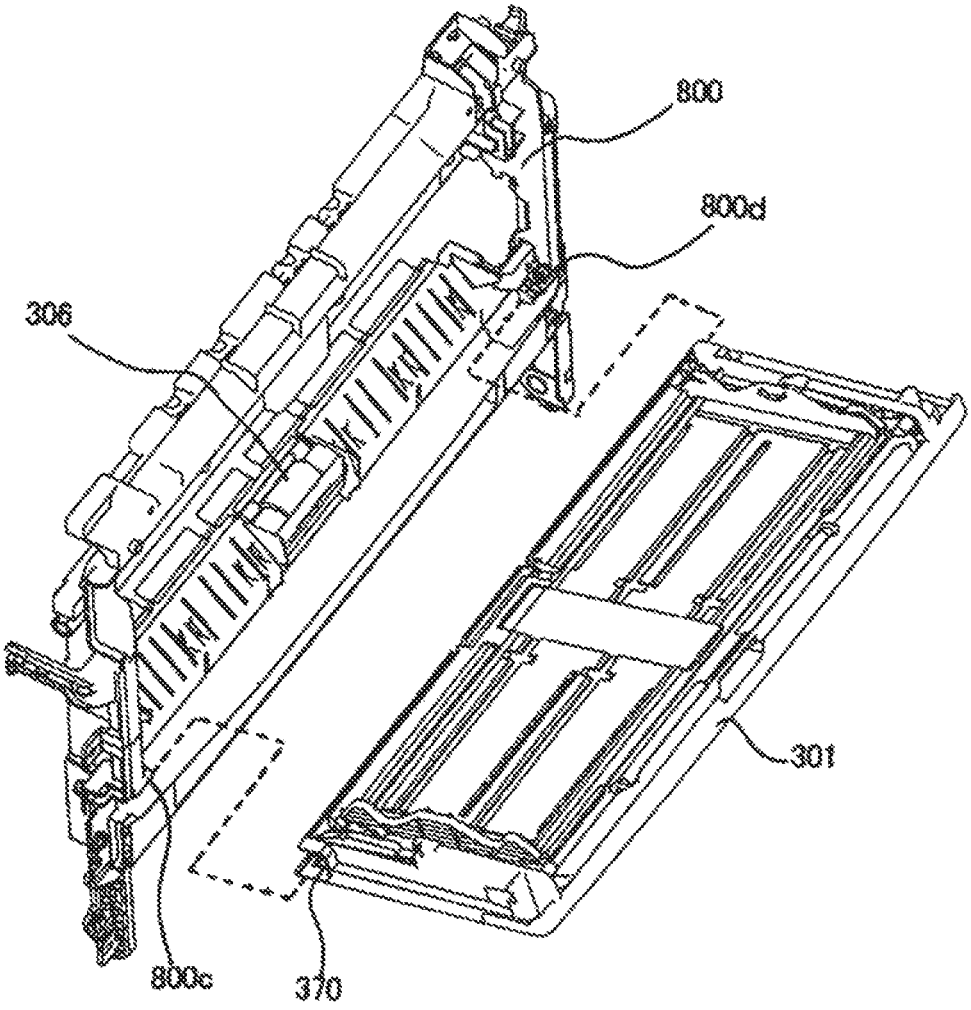
FIG. 19 is a perspective view of the manual tray according to the first embodiment, showing the manual tray detached from the image formation apparatus main body and broken down.

Manual tray 300 is connected to apparatus main body 800 (image formation apparatus 1) by engaging engagement part 370 shown in FIG. 19 with shaft parts 800*c* and 800*d* formed in main body 800. Manual tray 300 is configured rotatably (slidably) around the connection mechanism. When manual tray 300 is rotated and folded toward apparatus main body 800 (in arrow a direction shown in FIG. 5) by the connection mechanism, manual tray 300 is stored in storage area 801 on the apparatus main body 800 side, resulting in a state shown in FIG. 20. In this case, manual tray 300 is stored in apparatus main body 800 (image formation apparatus 1) with the paper loader plate 302 side of manual tray 300 as the inside and frame 301 as the outside. More specifically, when manual tray 300 is stored in apparatus main body 800 (image formation apparatus 1), frame 301 also functions as a frame (outer wall) of apparatus main body 800 (image formation apparatus 10. Note, however, that the connection mechanism to connect image formation apparatus 1 to manual tray 300 is not limited to the above example, but various configurations of paper feed trays (medium loader devices) in existing printers can be employed.

Next, a description is given of a specific relationship among frame 301, paper loader plate 302 and paper holder plate 320 in manual tray 300.

Figure 11:
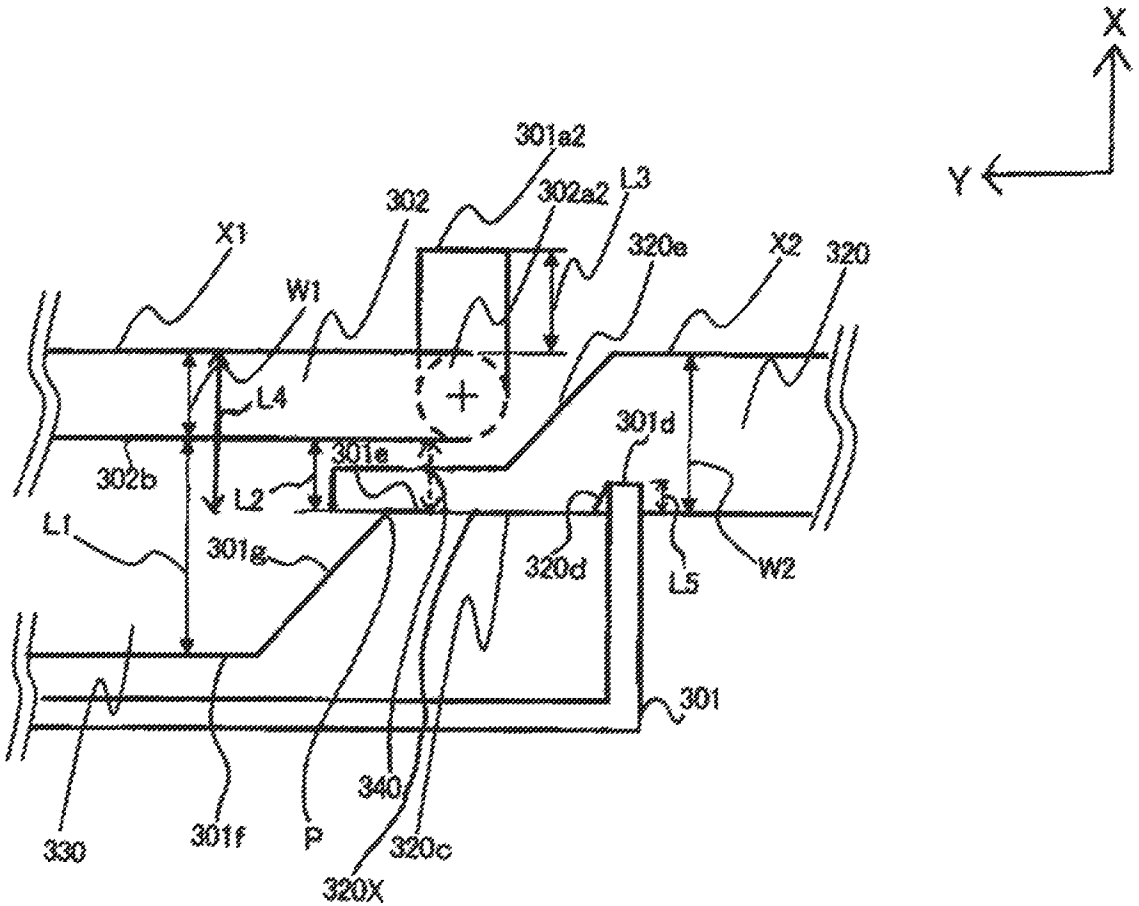
FIG. 11 is a schematic cross-sectional view of the manual tray according to the first embodiment, showing the paper holder plate disposed at the first position (usage position).

FIG. 11 is a schematic cross-sectional view showing a simplified shape of the cross-sectional view of manual tray 300 shown in FIG. 1. For ease of explanation, FIG. 11 shows the case where paper load surface X1 and paper load surface X2 form the same plane as an example where paper load surface X1 and paper load surface X2 are arranged without any difference in level.

Figure 12:
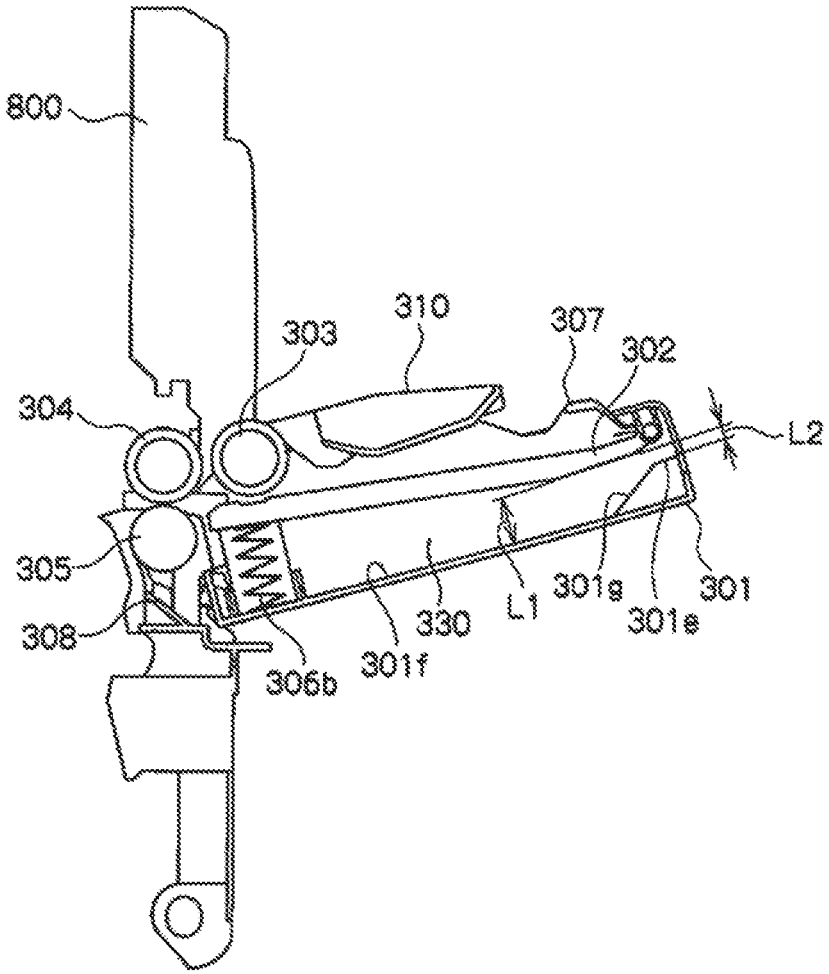
FIG. 12 is a cross-sectional view of the manual tray according to the first embodiment, showing the paper holder plate detached.
Figure 13:
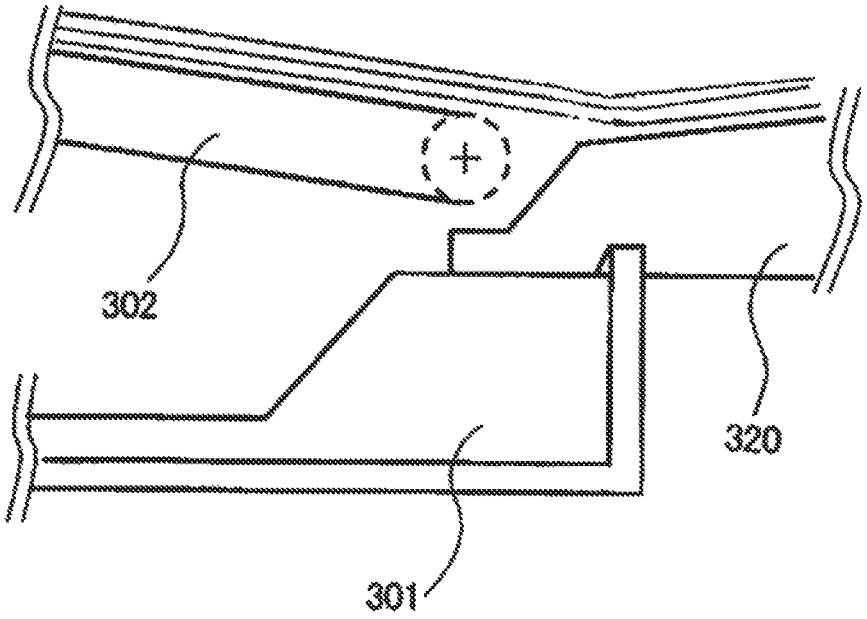
FIG. 13 is a schematic cross-sectional view (Part 1) of the manual tray according to the first embodiment, showing the paper loaded.
Figure 14:
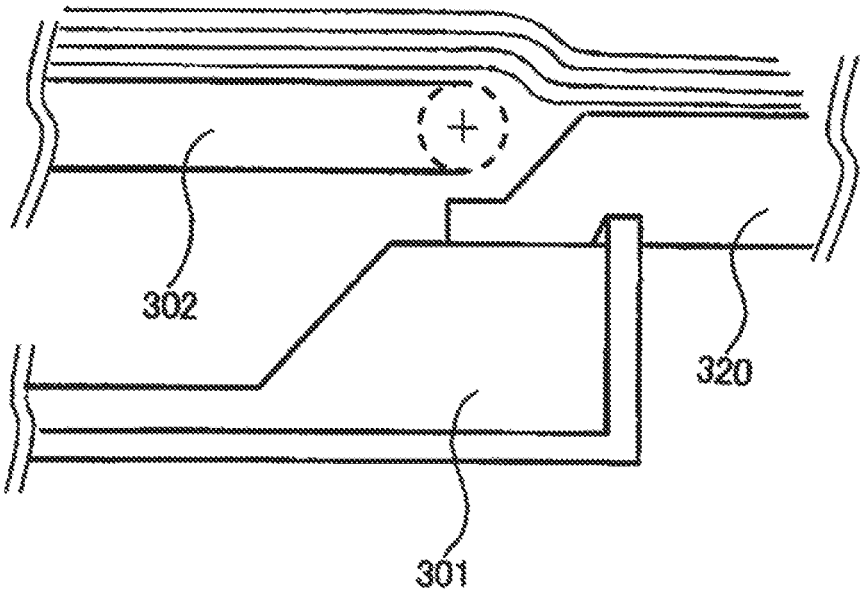
FIG. 14 is a schematic cross-sectional view (Part 2) of the manual tray according to the first embodiment, showing the paper loaded.

FIG. 12 is a cross-sectional view of manual tray 300, showing that paper holder plate 320 is detached.

When paper holder plate 320 is set in the state (the first position) of being extended from paper loader plate 302 as the first medium loading plate, paper load surface X1 of paper loader plate 302 and second paper load surface X2 of paper holder plate 320 are preferably arranged without any difference in level, in order to smoothly feed and convey the paper from pickup roller 303. Therefore, as shown in FIG. 11, guide member 301*e* is formed in frame 301, which is configured to come into contact with bottom surface 320*c* of paper holder plate 320 when paper holder plate 320 is set in the first position by engagement protrusion part 301*d* of frame 301 locking paper holder plate 320 (engagement recess part 320*d*0. In other words, guide member 301*e* functions as a supporting stage to support paper holder plate 320 so that there is no difference in level between paper load surface X1 of paper loader plate 302 and second paper load surface X2 of paper holder plate 320 at the position where engagement recess part 320*d* of paper holder plate 320 is locked by engagement protrusion part 301*d* of frame 301.

To be more specific, as shown in FIG. 11, a positional relationship in a height direction (in X direction shown in FIG. 11) between paper load surface X1 and paper load surface X2 is controlled by contact between the top surface of guide member 301*e* and bottom surface 320*c* of paper holder plate 320.

Moreover, when a distance between paper load surface X1 and bottom surface 302*b* on the opposite side in paper loader plate 302 (a thickness of paper loader plate 302) is W1, distance L9 between the top surface of guide member 301*e* and paper load surface X1 is preferably L9 =L2+W1.

Note that L2 represents a width (distance) of space 340 formed between bottom surface 302*b* of paper loader plate 302 and the top surface of guide member 301*e* when posts 302*a*1 and 302*a*2 of paper loader plate 302 come into contact with the lower ends of guide members 301*b*1 and 301*b*2 of frame 301 as shown in FIGS. 11 and 12.

Here, when a distance between paper load surface X2 and bottom surface 320*c* is W2, it is preferable that W2=L4=L2+W1, i.e., it is preferable that W2>L2.

In the process of moving paper holder plate 320 from the first position shown in FIG. 6 to the storage area 330 (the second position shown in FIG. 8) formed vertically below paper loader plate 302 (bottom side in FIG. 11), paper loader plate 302 and paper holder plate 320 may interfere (come into contact) with each other since W2>L2, which can hinder the movement.

To solve this problem, as shown in FIG. 11, paper holder plate 320 is provided with slope part 320*e* sloping upward in the drawing direction from below (bottom side in FIG. 11) bottom surface 302 that comes into contact with paper loader plate 302. In other words, slope part 320*e* slopes toward bottom surface 302*b* of paper loader plate 302 from paper load surface X2 when paper holder plate 320 is in the first position.

When paper holder plate 320 slides and moves in the Y direction (storage direction) with slope part 320*e* being in sliding contact with paper loader plate 302, slope part 320*e* lifts posts 302*a*1 and 302*a*2 to be fulcrums in the X direction (upward). In this event, elongate holes 301*a*1 and 301*a*2 function as regulators to regulate the sliding direction (movement direction) of posts 302*a*1 and 302*a*2 to be the fulcrums of paper holder plate 320. If L3+L2>W2 is satisfied as shown in FIG. 11, L3 being a distance by which posts 302*a*1 and 302*a*2 can slide and move upward (in the X direction) within the range of elongate holes 301*a*1 and 301*a*2, paper holder plate 320 can be stored in storage area 330 provided below paper loader plate 302.

In FIG. 11, 301*f* denotes a bottom surface of storage area 330, i.e., a portion of the top surface of frame 301 in a region that has the longest distance from bottom surface 302*b* of paper loader plate 302 (a width of a space forming storage area 330) in the state where posts 302*a*1 and 302*a*2 of paper holder plate 320 are in contact with the lower ends of elongate holes 301*a*1 and 301*a*2 as shown in FIG. 11. In this case, paper holder plate 320 can be stored in storage area 330 if L1>W2 is satisfied, where L1 is a distance (space width) between bottom surface 302*b* of paper loader plate 302 and bottom surface 301*f* of storage area 330.

Moreover, paper holder plate 320 has a guide part 320*x*. Guide part 320*x* is formed on the downstream side of slope part 320*e* in the paper feed direction. Furthermore, guide part 320*x* is positioned between bottom surface 302*b* and slope part 301*g* in the state where engagement protrusion part 301*d* and engagement recess part 320*d* are engaged with each other, and is extended to the downstream side of fulcrum P in the paper conveyance direction.

If distance L1 between bottom surface 301*f* of storage area 330 and bottom surface 302*b* of paper loader plate 302 is reduced, frame 301 can be reduced in size, thus leading to downsizing of the apparatus. In other words, L1 can be reduced if thickness W2 of paper holder plate 320 stored in storage area 330 is reduced. Therefore, in this embodiment, provided is slope part 301*g* which slopes upward from bottom surface 301*f* of storage area 330 (frame 301) to guide member 301*e*.

Slope part 301*g* reduces the distance between guide member 301*e* and paper load surface X2, i.e., can reduce distance W2 (the thickness of paper holder plate 320) between paper load surface X2 and bottom surface 320*c* which comes into contact with guide member 301*e*. In other words, the above effect can be achieved by providing a step that sets guide member 301*e* higher than bottom surface 301*f* of storage area 330 (frame 301). Therefore, the slope of slope part 301*g* is not limited.

Moreover, in this embodiment, the relative positions of paper loader plate 302 and paper holder plate 320 are fixed by engaging engagement protrusion part 301*d* as the first engagement part formed in frame 301 with engagement recess part 320*d* as the second engagement part engaged with engagement protrusion part 301*d* formed in paper holder plate 320. Here, in order to release the engagement between engagement protrusion part 301*d* and engagement recess part 320*d*, paper holder plate 320 needs to be moved vertically upward by movement amount L5 (a depth of engagement recess part 320*d*). In this embodiment, slope part 301*g* makes it easy to release the engagement of paper holder plate 320 at fulcrum P by rotating paper holder plate 320 (lifting paper holder plate 320) in the DI1 direction shown in FIG. 1. Furthermore, guiding by slope part 301*g* continuous with fulcrum P enables a smooth operation for storage in storage area 330.

In this release operation, it is preferable that the engagement part (engagement protrusion part 301*d* and engagement recess part 320*d* ) between frame 301 and paper holder plate 320 be located on the upstream side of posts 302*a*1 and 302*a*2 (elongate holes 301*a*1 and 301*a*2) in the paper feed direction (the drawing direction side). Moreover, it is also preferable that fulcrum P be located on the downstream side of posts 302a1 and 302a2 (elongate holes 301a1 and 301a2) in the paper feed direction (the storage direction side).

FIG. 11 shows the example where paper load surface X1 and paper load surface X2 are positioned in approximately the same plane. However, another configuration in which paper load surface X2 is disposed to tilt at angle 8 (see FIG. 6) to paper load surface X1 (paper loader plate 302 is disposed in a position lifted upward as shown in FIG. 6) makes a difference in level unlikely to occur between paper load surface X1 and paper load surface X2 without needing strict requirements for dimensional accuracy. This is as compared with the case where paper load surface X1 and paper load surface X2 are positioned in exactly the same plane.

As described above, the relationship of W1, W2, L2 and L1 described in FIG. 11 is satisfied in this embodiment, with W1 being the maximum value of the distance between paper load surface X1 and bottom surface 302b, W2 being the maximum value of the distance between paper load surface X2 and bottom surface 320c, L2 being the minimum value of the distance between paper loader plate 302 and guide member 301e, and L1 being the minimum value of the distance between paper loader plate 302 and bottom surface 301f of storage area 330.

However, the dimensions described above with reference to FIG. 11 are just an example, and it is not essential to set all the dimensions as described above.

(A-2) Effects of First Embodiment

According to the first embodiment, the following effects can be achieved.

Figure 20:
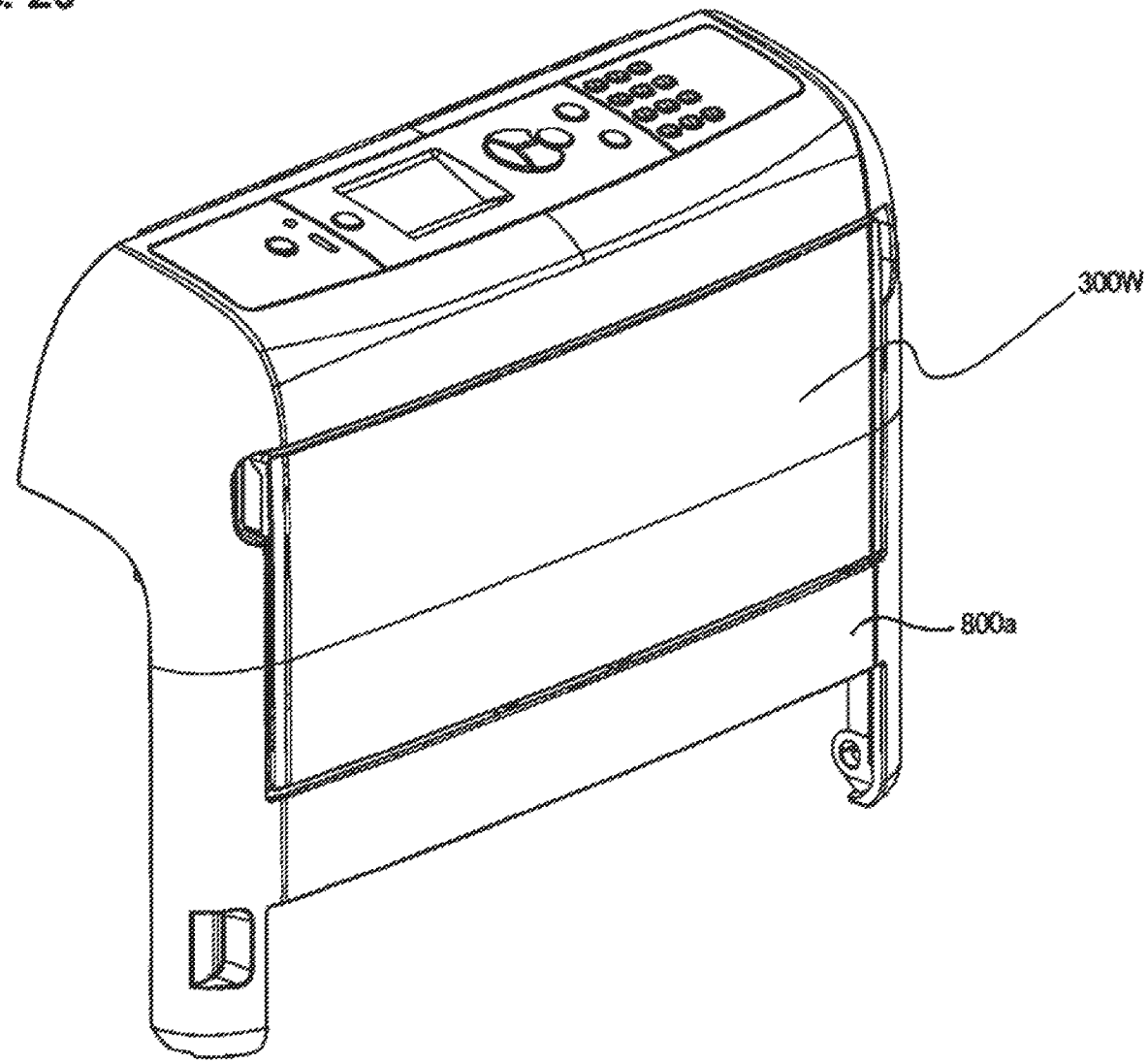
FIG. 20 is a perspective view of the manual tray according to the first embodiment, showing the manual tray stored (in a folded state) in the image formation apparatus main body.

In the first embodiment, manual tray 300 is stored in storage area 801 on the apparatus main body 800 side as shown in FIG. 20. To be more specific, outside part 301w of frame 301 is stored in a way forming approximately the same plane with main body cover 800a as a peripheral part of the apparatus main body. Thus, if the thickness (W3 in FIG. 8) of frame 301 is increased, for example, a larger storage space needs to be secured inside the apparatus main body 800.

In manual tray 300 of the first embodiment, posts 302a1 and 302a2 as rotation fulcrums provided in paper mounting plate 302 are supported in a vertically movable state by elongate holes 301a1 and 301a2. Thus, paper loader plate 302 can be moved in a direction that does not hinder movement of paper holder plate 320 only when paper holder plate 320 is moved to storage area 330. Therefore, paper holder plate 320 can be disposed and stored in a small space between frame 301 and paper loader plate 302. Thus, thickness W3 of manual tray 300 can be reduced, and the space required to store manual tray 300 can be further reduced.

(B) Second Embodiment

A second embodiment of a medium loader device and an image formation apparatus according to the invention is described in detail below with reference to the drawings. Note that the medium loader device of the second embodiment is a manual tray.

(B-1) Configuration and Operations of Second Embodiment

Figure 15:
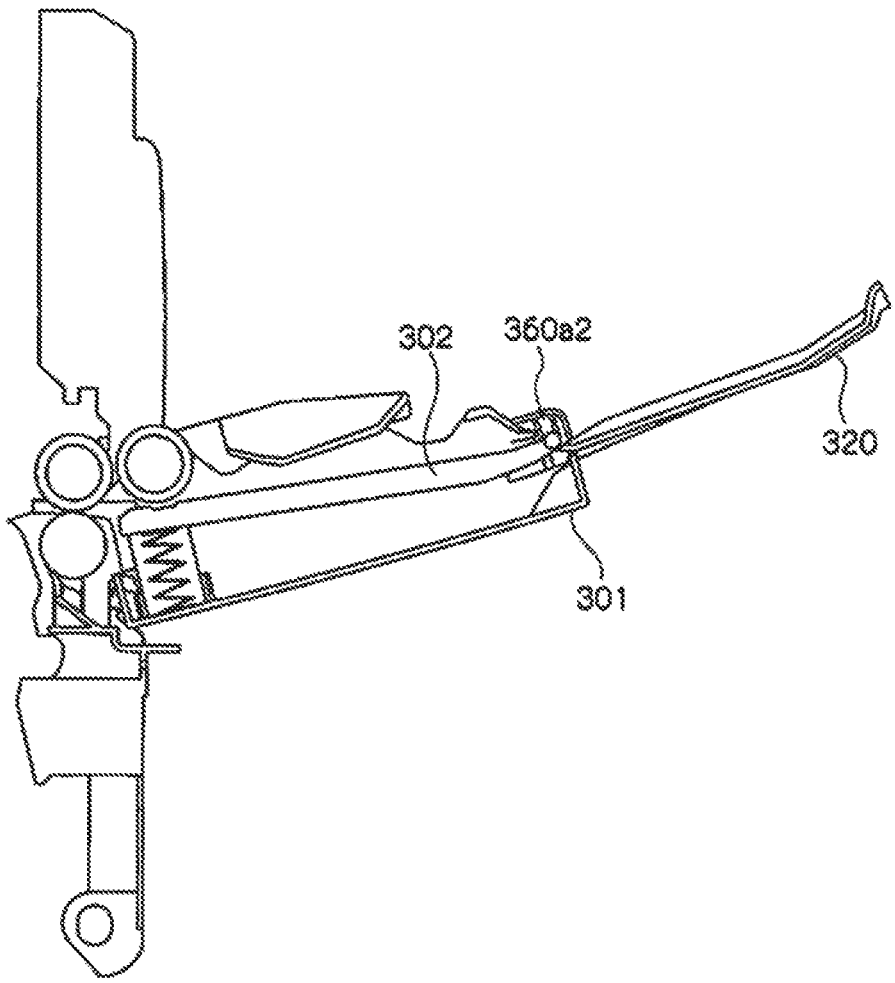
FIG. 15 is a cross-sectional view of a manual tray according to a second embodiment, showing the manual tray attached to an image formation apparatus.

As shown in FIG. 15, manual tray 300 of the second embodiment is different from that of the first embodiment by including spring 360 as an elastic member. Since the other configuration is the same as that of the first embodiment, spring 360 is mainly described below.

Spring 360 biases paper loader plate 302 downward in FIG. 15.

In manual tray 300 of the second embodiment, the number of springs 360 to be provided and arrangement thereof are not limited. However, in this embodiment, a pair of springs 360a and 360b are provided at positions between upper ends of elongate holes 301a1 and 301a2 and posts 302a1 and 302a2, respectively.

Next, a description is given of an operation of storing paper holder plate 320 in storage area 330 in manual tray 300 of the second embodiment.

Figure 16:
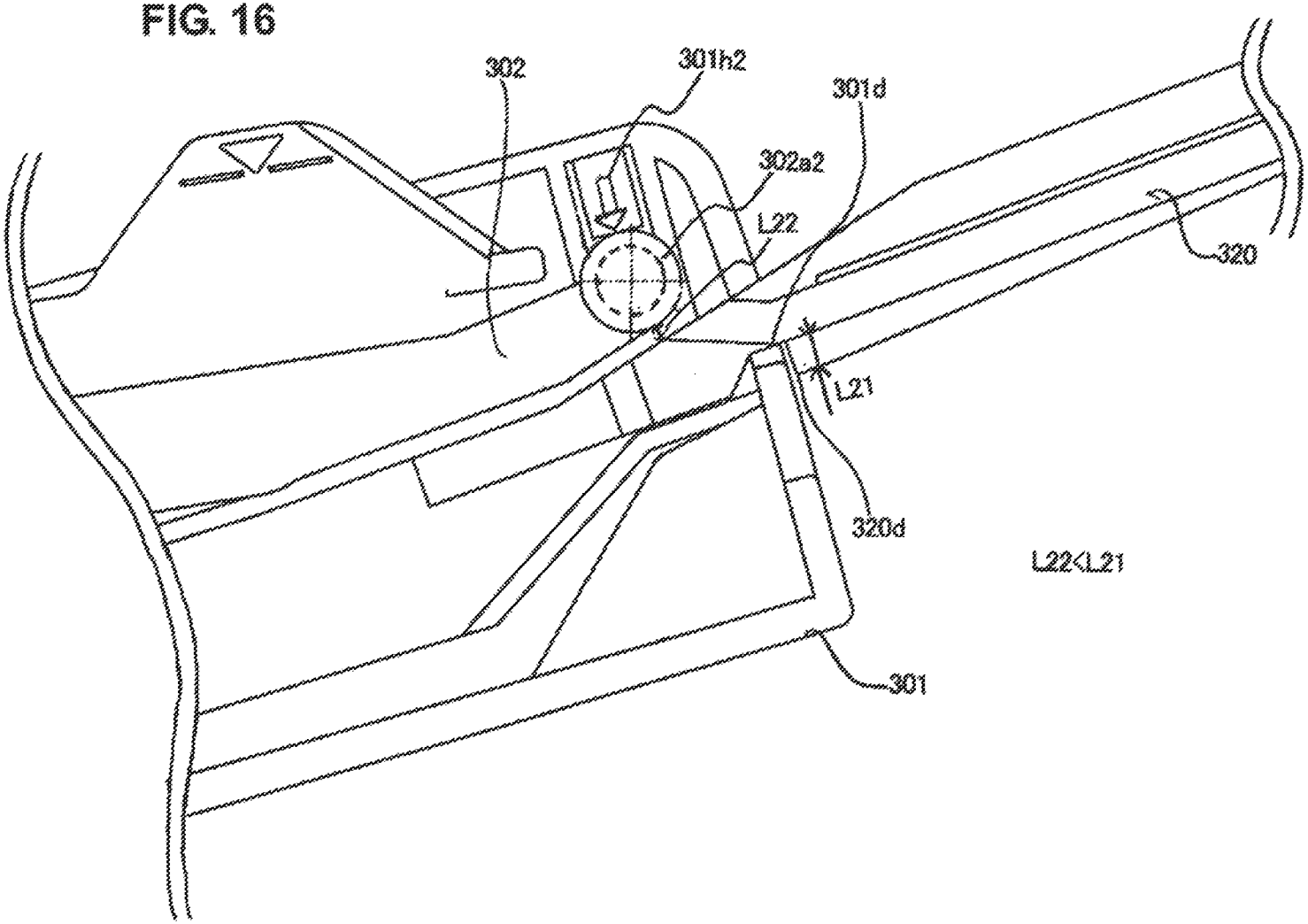
FIG. 16 is a partially enlarged cross-sectional view of the manual tray according to the second embodiment, showing a paper holder plate disposed at a first position (usage position).

FIG. 16 is a cross-sectional view showing the case where paper holder plate 320 of manual tray 300 is in the first position in image formation apparatus 1 of the second embodiment. In FIG. 16, paper loader plate 302 is biased toward the bottom of elongate holes 301a1 and 301a2 (downward in FIG. 16) by springs 360a and 360b. Here, a space between paper loader plate 302 and paper holder plate 320 is L22, and a fitting amount (a depth of engagement recess part 320d ) when engagement recess part 320d of paper holder plate 320 is engaged with frame 301 (engagement protrusion part 301d ) is L21. In this event, it is preferable that L21>L22.

Moreover, as shown in FIG. 16, when paper holder plate 320 is in the first position, movement of paper holder plate 320 is blocked by paper loader plate 302 since L21>L22. When paper holder plate 320 is moved upward (upward in FIG. 16), paper loader plate 302 is also moved upward while pushing spring 350. As engagement recess part 320d is lifted to a position beyond the frame, paper holder plate 320 can be moved in the storage direction (toward the second position).

Figure 17:
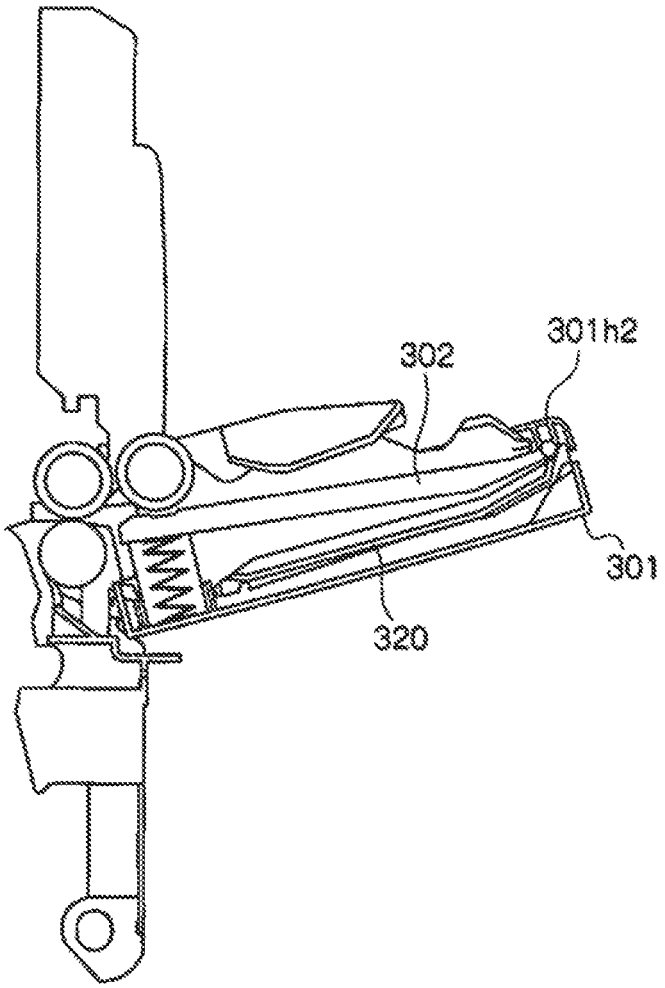
FIG. 17 is a cross-sectional view of the manual tray according to the second embodiment, showing the paper holder plate disposed at a second position (storage position).
Figure 18:
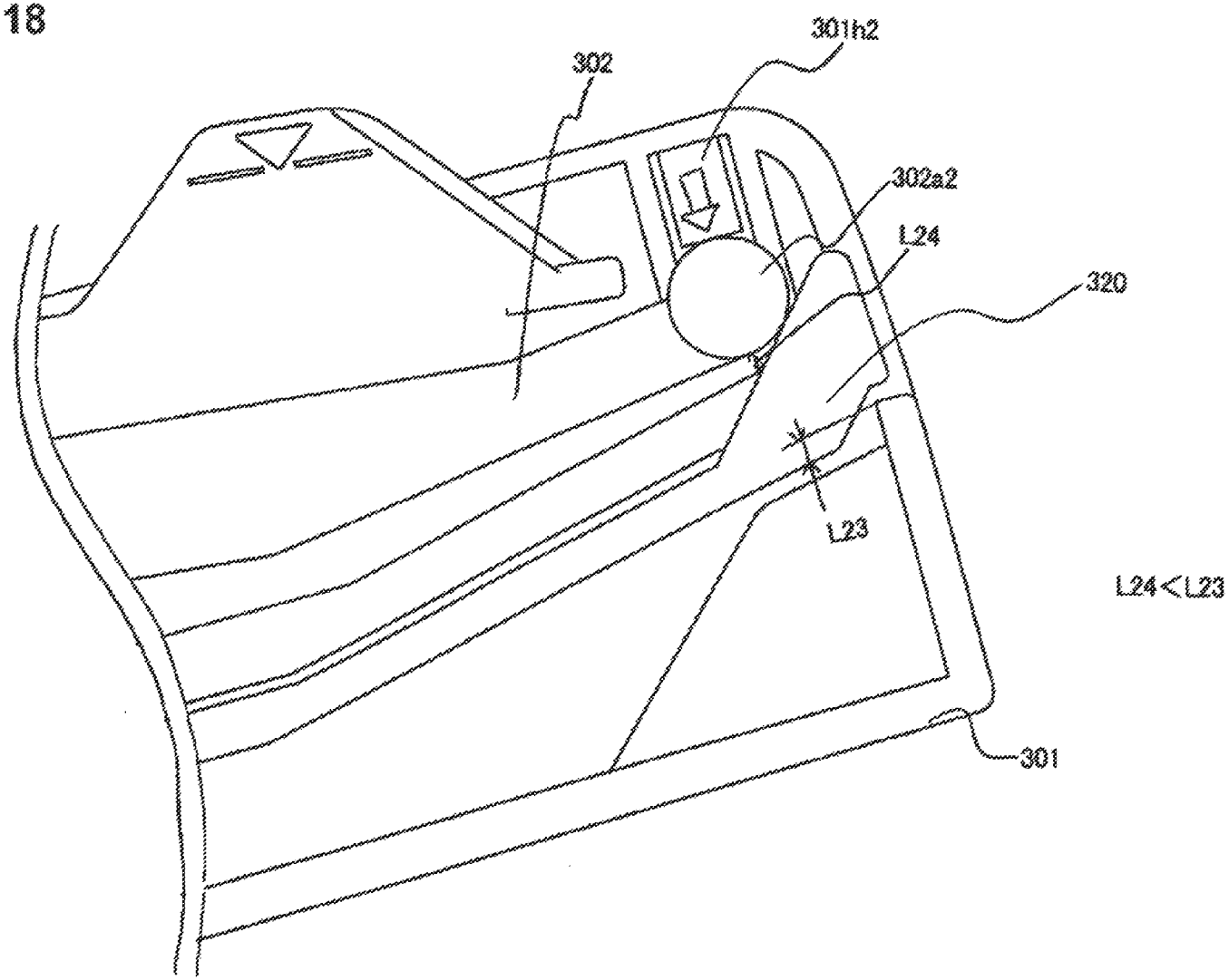
FIG. 18 is a partially enlarged cross-sectional view of the manual tray according to the second embodiment, showing the paper holder plate disposed at the second position (storage position).

FIG. 17 is a cross-sectional view showing the case where paper holder plate 320 of manual tray 300 is in the second position in image formation apparatus 1 of the second embodiment. FIG. 18 is a partially enlarged cross-sectional view showing the case where paper holder plate 320 is in the second position (in the state shown in FIG. 17) in manual tray 300 of the second embodiment.

As shown in FIGS. 17 and 18, paper loader plate 302 is biased toward the bottom of elongate holes 301a1 and 301a2 (downward in FIGS. 17 and 18) by springs 301h1 and 301h2. Here, a space between paper loader plate 302 and paper holder plate 320 is L24, and an overlapping amount between paper holder plate 320 and frame 301 is L23. As shown in FIG. 18, L23 is a distance (difference in height) between bottom surface 321b of paper holder plate 320 and the tip of engagement protrusion part 301d of frame 301 in a vertical direction (in a direction perpendicular to the top surface of guide member 301e ). In this event, L23>L24 is satisfied as shown in FIG. 18.

Moreover, as shown in FIG. 18, when paper holder plate 320 is in the second position, movement of paper holder plate 320 in the drawing direction can be blocked since L23>L24. When paper holder plate 320 is moved upward (upward in FIGS. 17 and 18) from the state shown in FIGS. 17 and 18, paper loader plate 302 is also moved upward while pushing springs 301h1 and 301h2. As the lower end of bottom surface 321b of paper holder plate 320 is lifted to a position above frame 301, paper holder plate 320 can be moved in the drawing direction (toward the first position).

(B-2) Effects of Second Embodiment

According to the second embodiment, the following effects can be achieved.

In the second embodiment, springs 301h1 and 301h2 configured to bias posts 302a1 and 302a2 of paper loader plate 302 downward are provided in frame 301. Thus, the movement of paper loader plate 302 can be blocked when paper loader plate 302 is located at the first position and the second position. Moreover, paper holder plate 320 can be surely kept at the first position and the second position.

(C) Other Embodiments

The invention is not limited to the embodiments described above, but may include modified embodiments as described below.

(C-1)

While, in the above embodiments, the description is given of the example where the manual tray (medium loader device) of the invention is applied to a printer, the manual tray may be applied to other image formation apparatuses (e.g., a multi-function printer (MFP), a FAX machine, a copier and the like).

(C-2)

While manual tray 300 is connected to image formation apparatus 1 in the above embodiments, manual tray 300 may be detachably connected thereto and independently detached therefrom.

(C-3)

While image formation apparatus 1 includes paper tray 100 in the above embodiments, paper tray 100 may be omitted and image formation apparatus 1 may be configured to receive paper (medium) fed only from manual tray 300.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A medium loader device comprising:

a first medium loader member configured to load a medium;

a second medium loader member usable as an extension of the first medium loader member; and a support member configured to support the first medium loader member and the second medium loader member and to form a storage area capable of storing the second medium loader member between the support member and the first medium loader member, wherein the support member includes a holder configured to hold the first medium loader member such that the first medium loader member moves relative to the support member when the second medium loader member is moved from a usage position where the second medium loader member is used as the extension of the first medium loader member to a storage position where the second medium loader member is stored in the storage area, wherein the second medium loader member has a guide part configured to move the first medium loader member upwardly by coming into slide contact with the first medium loader member when the second medium loader member is moved from the usage position to the storage position.

2. The medium loader device according to claim 1, wherein the support member further includes a second loader member support part configured to support the second loader member movably between the usage position and the storage position.

3. The medium loader device according to claim 1, wherein the storage area is positioned below the first medium loader member by disposing the support member below the first medium loader member.

4. The medium loader device according to claim 1, wherein the first medium loader member and the second medium loader member each have a predetermined thickness, and the support member further includes a support base part configured to mount a bottom surface of the second medium loader member when the second medium loader member is in the usage position.

5. The medium loader device according to claim 1, wherein the support member further includes a support base part configured to locate a medium load surface of the first medium loader member and a medium load surface of the second medium loader member in a same plane with a bottom surface of the second medium loader member mounted on the support base part when the second medium loader member is in the usage position.

6. An image formation apparatus comprising:

the medium loader device according to claim 1.

7. The image formation apparatus according to claim 6, further comprising:

an image formation unit configured to form a developer image;

a transfer unit configured to transfer the developer image onto a medium; and a fixing unit configured to fix the developer image, transferred onto the medium, to the medium.

8. The medium loader device according to claim 1, wherein when the second medium loader member is moved from the usage position to the storage position, the first medium loader member moves, by the guide part, upwardly in a direction from a side opposite from the surface of the first medium loader member toward a side of which the surface of the first medium loader member faces.

9. A medium loader device comprising:

a first medium loader member configured to load a medium;

a second medium loader member usable as an extension of the first medium loader member; and a support member configured to support the first medium loader member and the second medium loader member and to form a storage area capable of storing the second medium loader member between the support member and the first medium loader member, wherein the support member includes a holder configured to hold the first medium loader member such that the first medium loader member moves relative to the support member when the second medium loader member is moved from a usage position where the second medium loader member is used as the extension of the first medium loader member to a storage position where the second medium loader member is stored in the storage area, wherein the first medium loader member and the second medium loader member each have a predetermined thickness, the support member further includes a support base part configured to mount a bottom surface of the second medium loader member when the second medium loader member is in the usage position, and a thickness of the second medium loader member is larger than a distance between the support base part and the first medium loader member when the second medium loader member is in the usage position.

* * * * *